US007072602B2

(12) United States Patent
Hatori et al.

(10) Patent No.: US 7,072,602 B2
(45) Date of Patent: Jul. 4, 2006

(54) IMAGE FORMING APPARATUS AND IMAGE FORMING UNIT

(75) Inventors: Satoshi Hatori, Yokohama (JP); Kiyonori Tsuda, Yokohama (JP); Naoto Watanabe, Matsudo (JP); Takeo Suda, Katushika-ku (JP); Yuji Arai, Kawasaki (JP); Tomoji Ishikawa, Yokohama (JP); Atsushi Sampe, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/861,526

(22) Filed: Jun. 7, 2004

(65) Prior Publication Data

US 2004/0258432 A1 Dec. 23, 2004

(30) Foreign Application Priority Data

Jun. 5, 2003 (JP) ..... 2003-161293

(51) Int. Cl.
*G03G 21/18* (2006.01)

(52) U.S. Cl. ..... 399/111; 399/112

(58) Field of Classification Search ..... 399/110–113, 399/116, 124, 117, 120, 109
See application file for complete search history.

(56) References Cited

U.S. PATENT DOCUMENTS

| | | | | |
|---|---|---|---|---|
| 5,109,254 | A | 4/1992 | Oka et al. | |
| 5,235,384 | A | 8/1993 | Oka et al. | |
| 5,638,158 | A | 6/1997 | Sanpe et al. | |
| 5,991,569 | A | 11/1999 | Sugihara et al. | |
| 6,081,676 | A * | 6/2000 | Inomata | 399/111 X |
| 6,128,454 | A * | 10/2000 | Kawai et al. | 399/116 |
| 6,643,482 | B1 * | 11/2003 | Higeta et al. | 399/109 |
| 6,721,520 | B1 * | 4/2004 | Higeta et al. | 399/109 |
| 2001/0021320 | A1 * | 9/2001 | Murayama et al. | 399/117 |
| 2001/0055500 | A1 * | 12/2001 | Katakabe et al. | 399/111 |
| 2002/0081125 | A1 * | 6/2002 | Karakama et al. | 399/111 |
| 2003/0053819 | A1 * | 3/2003 | Nomura et al. | 399/112 X |
| 2004/0175203 | A1 * | 9/2004 | Kamimura | 399/111 |
| 2004/0234293 | A1 * | 11/2004 | Karakama et al. | 399/111 |

FOREIGN PATENT DOCUMENTS

| | | | |
|---|---|---|---|
| JP | 8-36346 | | 2/1996 |
| JP | 08-339147 | A * | 12/1996 |
| JP | 2001-356549 | | 12/2001 |
| JP | 2002-82507 | | 3/2002 |
| JP | 2002-108050 | | 4/2002 |

OTHER PUBLICATIONS

U.S. Appl. No. 11/269,717, filed Nov. 9, 2005, Fujimori et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus including at least two image forming units arranged side by side in an arrangement direction and each of the image forming units contains a photoconductor configured to bear a latent electrostatic image thereon and at least one process device configured to form a toner image on the photoconductor, and a unit case having a notch thereon to grasp the unit case.

20 Claims, 10 Drawing Sheets

IMAGE FORMING APPARATUS AND IMAGE FORMING UNIT

BACKGROUND OF THE INVENTION

1. Field of the Invention

The present invention relates to an image forming unit for forming an image on a photoconductor, which contains at least one process device, such as a charger, a developing device, a cleaner and a quencher. The process device forms a toner image on the photoconductor. In addition, the present invention further relates to an image forming apparatus including a photoconductor and at least two image forming units mentioned above which are arranged in parallel in the image forming apparatus.

2. Discussion of the Background

The image forming apparatus mentioned above, which constitutes a copier, a printer, a facsimile machine, a multifunctional machine, etc. is a known technology as disclosed in, for example, published unexamined Japanese patent application No. 8-36346. In these image forming apparatuses where each image forming unit is set close to or in contact with each other, it is difficult to remove any one of the image forming units since there is not enough space for fingers between the image forming units.

To address this problem, it is possible to attach a handle to the unit case of each image forming unit and pull out the image forming unit with the handle. For example, a handle can be attached to the upper wall of each image forming unit such that the handle protrudes upward from the upper wall. With this handle, the image forming unit can be lifted upward. Therefore, with this structure, it is easy to detach an image forming unit even when each image forming unit is set close to or in contact with another image forming unit.

However, the handle attached to the unit case significantly protrudes from the unit case. Therefore, when each image forming unit with a handle is arranged in the image forming apparatus, these image forming units occupy a larger large space in the image forming apparatus. Naturally, it is inevitable that the image forming apparatus becomes larger.

Therefore, a need exists for an image forming unit which can be easily detached from an image forming apparatus without occupying a large space therein.

SUMMARY OF THE INVENTION

Accordingly, one object of the present invention is to provide an image forming apparatus containing a plurality of compact-sized image forming units for forming an image on a photoconductor, wherein the photoconductor and image forming units can be easily detached from the image forming apparatus and replaced when the photoconductor and/or the image forming units are exhausted.

Briefly, it will become readily apparent that this object and other objects of the present invention as hereinafter described can be attained by an image forming apparatus containing a plurality of image forming units arranged side by side in an arrangement direction. The image forming unit includes a photoconductor and at least one process device configured to form a toner image on the photoconductor. The image forming unit further includes a unit case with a notch thereon that makes it easier to grasp, lift, remove and replace the image forming unit.

It is preferred that the at least one process device be selected from the group consisting of a charger, a developing device, a cleaner and a quencher.

It is also preferred that the image forming unit contained in the image forming apparatus have the notch on the upper part of each image forming unit and at a same end of the each image forming unit relative to the arrangement direction.

It is also preferred that each image forming unit contained in the image forming apparatus be slidably supported so that the image forming unit can be pulled out and pushed into each image forming apparatus, and each image forming unit can be lifted upward and detached from the image forming apparatus after the image forming unit is pulled out of the image forming apparatus.

It is also preferred that the photoconductor be configured to detach from the image forming unit.

It is also preferred that, in the image forming apparatus, the notch is formed on a stay portion of the unit case that connects a front wall and a back wall of the unit case.

It is also preferred that the at least one process device contain at least a developing device configured to convert a latent electrostatic image formed on the photoconductor into a toner image, the developing device has a developing device case constituting a portion of the unit case, and the notch is formed on a portion of the unit case other than the developing unit case.

It is also preferred that, in the image forming apparatus including at least one process device containing a developing device, the notch is formed on a stay portion of the unit case that connects a front wall and a back wall of the unit case.

It is also preferred that, with regard to the image forming apparatus, as each of the at least two image forming units are pulled out of the image forming apparatus, a distance between the at least one process device and the photoconductor increases, and when each of the at least two image forming units are pushed into the image forming apparatus, the distance between the at least one process device and the photoconductor decreases.

As another aspect of the present invention, an image forming apparatus is provided which includes a photoconductor configured to bear a latent electrostatic image thereon, at least one process device configured to form a toner image on the photoconductor and a unit case having a notch thereon to grasp the unit case.

It is preferred that, in the image forming unit mentioned above, the notch is formed on a stay portion of the unit case that connects a front wall and a back wall of the unit case.

It is also preferred that, in the image forming unit, the photoconductor is configured to detach from the image forming unit.

It is also preferred that, in the image forming unit, mentioned above, the at least one process device includes a developing device configured to convert a latent electrostatic image formed on the photoconductor into a toner image, the developing device including a developing device case that constitutes a portion of the unit case, and the notch is formed on a portion of the unit case other than the developing device case.

It is also preferred that, in the image forming unit at least including a developing device, the notch is formed on a stay portion of the unit case that connects a front wall and back wall of the unit case.

As another aspect of the present invention, an image forming apparatus is provided which includes a means for forming a latent electrostatic image on a photoconductor, a means for converting the latent electrostatic image into a toner image and a means for replacing the means for forming a latent electrostatic image using at least one notch on the means for forming a latent electrostatic image for grasping, removing, and replacing the means for forming a latent electrostatic image.

As another aspect of the present invention, a method for removing an image forming unit from an image forming apparatus is provided which includes the steps of pulling out at least two slidably supported image forming units arranged side by side from the image forming apparatus, grasping at least one of the at least two slidably supported image forming units using at least one notch formed on an upper part of each image forming unit and lifting any one of the at least two image forming units from the image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the present invention becomes better understood from the detailed description when considered in connection with the accompanying drawings, in which like reference characters designate like corresponding parts throughout, and wherein.

DETAILED DESCRIPTION OF THE INVENTION

The present invention will be described below in detail with reference to several embodiments and accompanying drawings.

Figure 1:
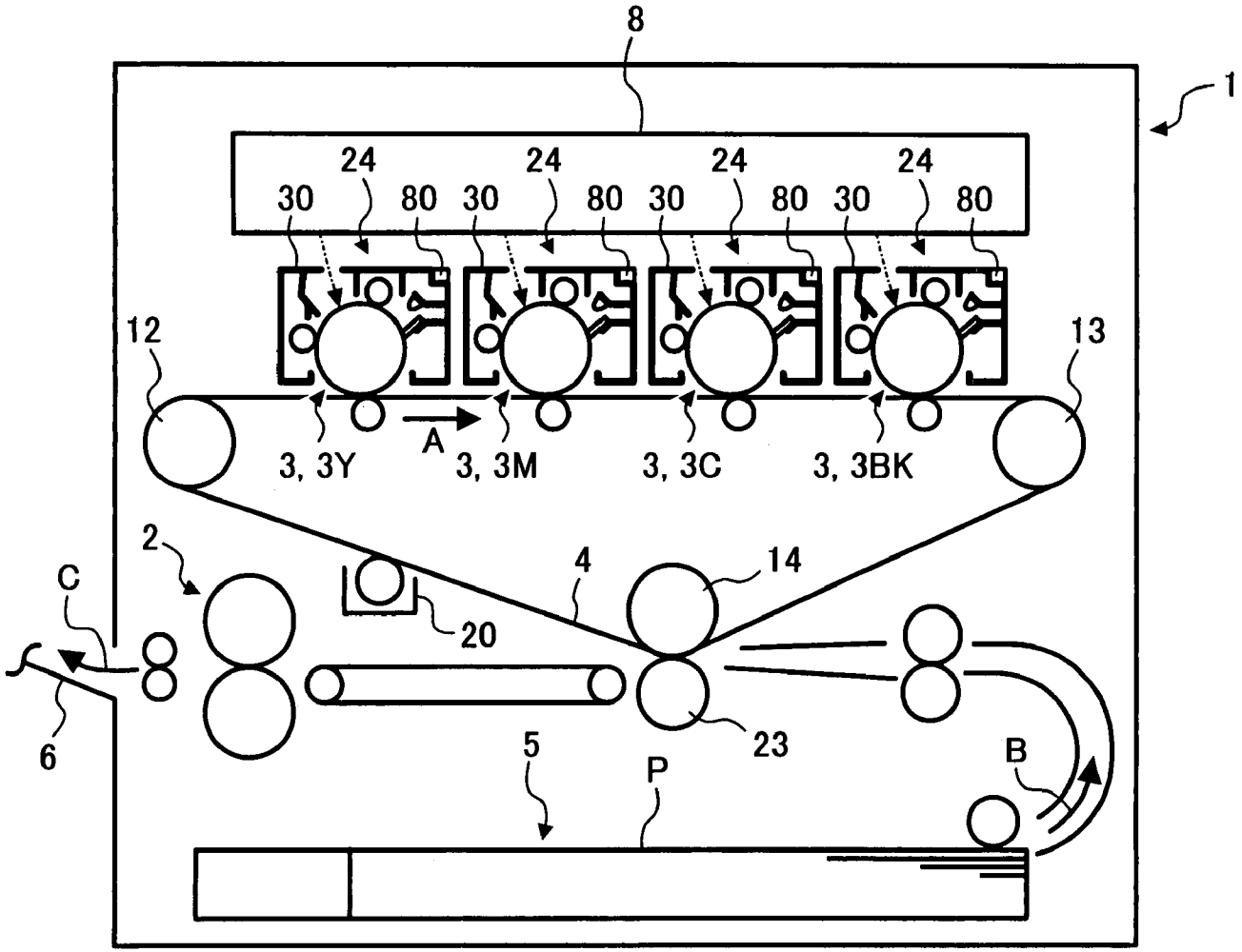
FIG. 1 is a schematic cross section illustrating an example of the image forming apparatus.

An image forming apparatus 1 illustrated in FIG. 1 contains four photoconductors, i.e., a photoconductor 3Y, a photoconductor 3M, a photoconductor 3C, and a photoconductor 3BK. The four photoconductors are referred to as a photoconductor 3 when it is not necessary to distinguish each of the four photoconductors. A yellow toner image, a magenta toner image, a cyan toner image, and a black toner image are formed on respective photoconductors 3Y, 3M, 3C and 3BK. In this embodiment, the photoconductor 3 has a drum form but a photoconductor having an endless belt can also be used.

An intermediate transfer member 4, which is an example of a transferring member, is arranged to face the four photoconductors 3Y, 3M, 3C and 3BK. The intermediate transferring member 4 illustrated in FIG. 1 includes an endless belt stretched and rotated by plural supporting rollers 12, 13 and 14 in the direction illustrated by arrow A.

Figure 2:
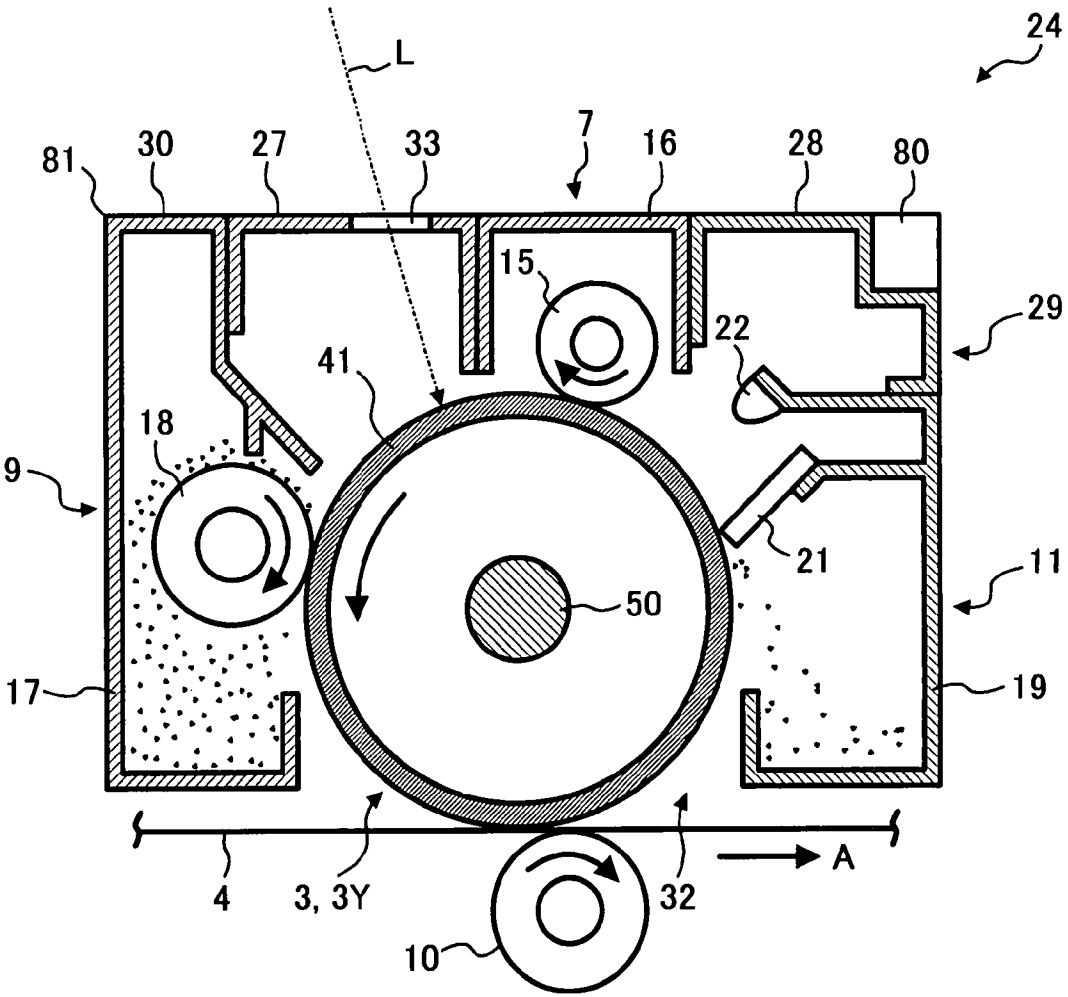
FIG. 2 is an enlarged cross section illustrating the image forming unit and the photoconductor.

Since the structure of each photoconductor 3 and the function of forming a toner image on each photoconductor 3 are substantially the same, only the structure for forming a toner image on the photoconductor 3Y is described here. FIG. 2 is an enlarged view illustrating the photoconductor 3Y and process devices arranged around the photoconductor 3Y. The photoconductor 3Y is driven counterclockwise in FIGS. 1 and 2. A charging device 7 charges the surface of the photoconductor 3Y to a predetermined polarity. The charging device 7 has a charging roller 15 rotatably supported facing the photoconductor 3Y, and a case 16 supporting the charging roller 15.

A light irradiator 8 irradiates the surface of the photoconductor 3Y charged by the charging device 7 as mentioned above with a writing light L, which is a laser beam in this embodiment. Thus a latent electrostatic image is formed on the photoconductor 3Y and converted by a developing unit 9 into a yellow toner image. The developing unit 9 illustrated in FIG. 2 has a developing unit case 17 and a developing roller 18 supported by the developing unit case 17 so as to be rotatably driven. The latent electrostatic image is converted by dry toner supported on the developing roller 18. This is how a toner image is formed on the surface on the photoconductor 3Y. In this embodiment, the light irradiator 8 is outside the image forming unit 24 but can be configured to be included in the image forming unit 24.

A first transferring device 10 including a transferring roller is located at a place which approximately faces the photoconductor 3Y with the intermediate transferring member 4 composed of an endless belt therebetween. The yellow toner image on the photoconductor 3Y is transferred to the intermediate transferring member 4 by function of the transferring device 10. The toners which have not been transferred to the intermediate transferring member 4 and still remain on the photoconductor 3Y are removed by a first cleaning device 11. The first cleaning device 11 contains a cleaning case 19 and a cleaning blade 21 supported by the cleaning case 19. The cleaning blade 21 contacts with the surface of the photoconductor 3Y and clears the surface of the photoconductor 3Y of the remaining toner. A quencher 22 irradiates the surface of the photoconductor 3Y which has passed the cleaning device 11 with light to initialize the potential of the surface of the photoconductor 3Y.

Similarly, a magenta toner image, a cyan toner image and a black toner image are formed on the respective photoconductors 3M, 3C and 3BK, respectively. These toner images are overlaid accordingly on the portion of the intermediate transfer member 4 where the yellow toner image has been transferred. The 4-color overlay toner image is thus formed on the intermediate transfer member 4.

Further, as illustrated in FIG. 1, a second transferring device 23 is provided facing the supporting roller 14 with the intermediate transfer member 4 composed of the endless belt therebetween. A paper feeder 5 is located at the bottom portion of the image forming apparatus 1. The paper feeder 5 feeds a recording material P, which is the final transfer material composed of a transferring paper, a resin film or the like, in the direction indicated by arrow B. The recording material P is transported to the transferring area between the second transferring device 23 and the intermediate transferring member 4 and then the toner image formed on the intermediate transfer member 4 is transferred to the recording material P by the function of the second transferring device 23. The recording material P bearing the transferred image thereon is transported to the fixing unit 2 and passes therethrough. At this point, the toner image is fixed on the recording material P upon application of heat and pressure and thus the full color image is formed on the recording material P. The recording material P which has passed the fixing unit 2 is transported in the direction indicated by arrow C and discharged to an output tray 6. In addition, a second cleaning device 20 clears the intermediate transfer member 4 of the toner remaining on the intermediate transfer member 4 after the toner image has been transferred to the recording material P.

As mentioned above and also illustrated in FIG. 2, process devices, which are the charging device 7, the developing unit 9, the transferring device 10, the first cleaning device 11 and the quencher 22, are placed around the photoconductor 3Y. Similarly, each process device mentioned above is placed around the photoconductors 3M, 3C and 3BK. These process devices convert a latent electrostatic image formed on each photoconductor 3 into a toner image, and transfer the toner image to a transfer material. In the embodiments illustrated in FIGS. 1 and 2, each toner image formed on each photoconductor 3 is transferred to the transferring member having the intermediate transfer member 4 and then the toner image thereon is transferred to the final transferring material, i.e., the recording material P. Also, it is possible to have a structure without the intermediate transfer member 4, in which a full color image is obtained by directly overlaying and transferring the toner image formed on each photoconductor 3 onto a transfer member composed of a recording material and fixing the overlay image by the fixing unit.

In the embodiment illustrated in FIG. 1, four image forming units 24 are provided. Each image forming unit 24 contains the process devices mentioned above, which are placed around each photoconductor 3 and form a toner image thereon.

Figure 3:
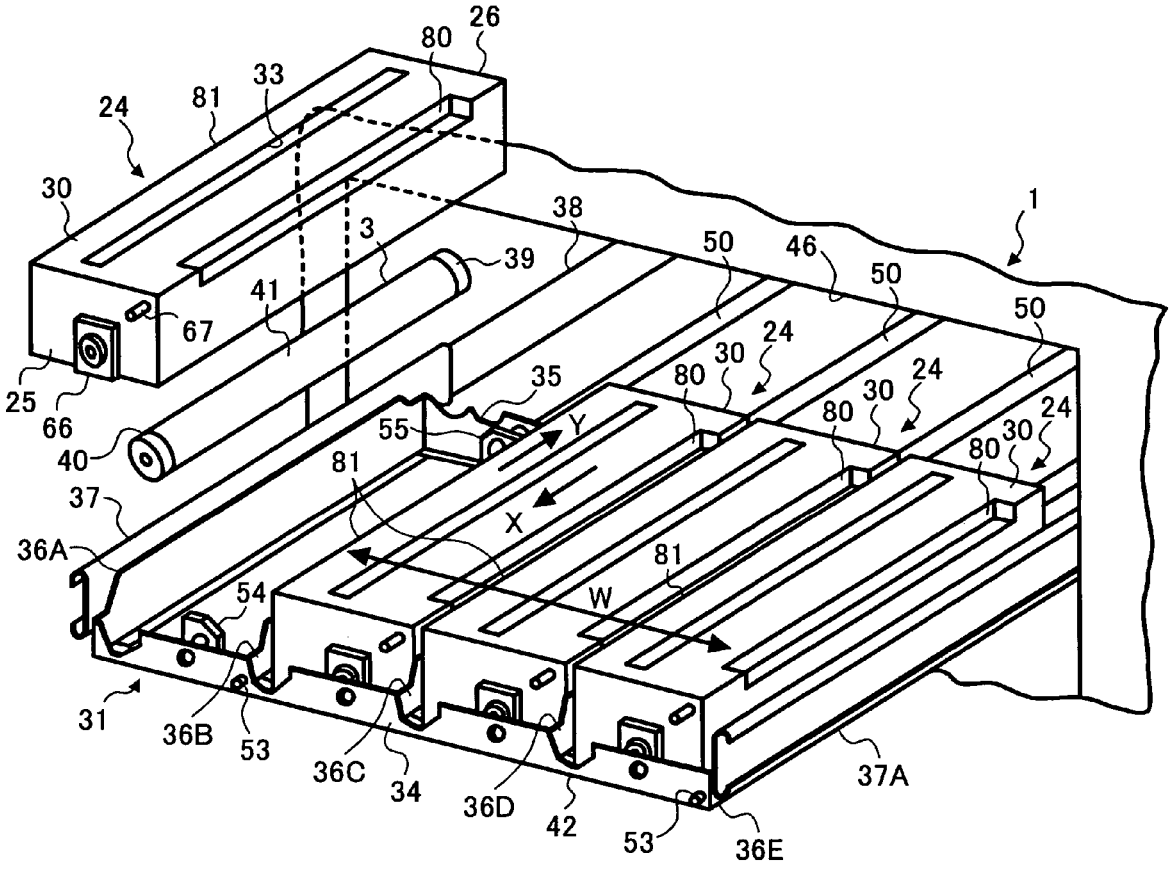
FIG. 3 is a perspective view illustrating a state of when the drawer is pulled out from the image forming apparatus and one of the image forming units and one of the photoconductors are detached from the drawer.
Figure 4:
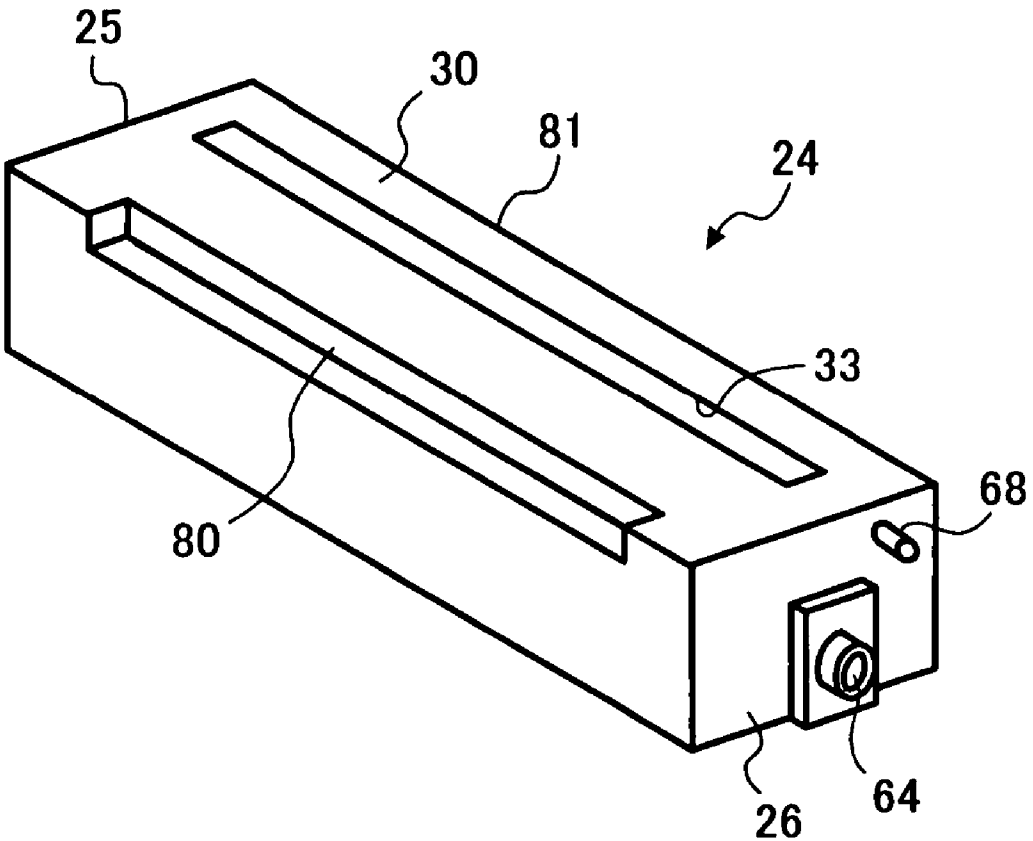
FIG. 4 is a perspective view illustrating the image forming unit looking from behind.

FIG. 3 illustrates one detached image forming unit 24 and one detached photoconductor 3 from a drawer 31, which is described later. FIG. 4 is a perspective view illustrating the image forming unit 24 from the counter direction to that in FIG. 3. As apparent from FIGS. 2 to 4, the image forming unit 24 contains a front wall 25, a back wall 26 and a unit frame 29. The unit frame 29 includes a first stay 27 and a second stay 28, which are illustrated in FIG. 2, to connect the front wall 25 and the back wall 26. Further, in one image forming unit 24, the charging device 7, the developing unit 9, the cleaning device 11 and the quencher 22 are detachably assembled in the unit frame 29.

A unit case 30 of the image forming unit 24 includes a case 16 for the charging device 7, a development case for the developing unit 9, and a cleaning case 19 for the first cleaning device 11. As illustrated in FIG. 2, a lower portion of the photoconductor 3 protrudes from a bottom opening 32 of the unit case 30. In addition, writing light L is incident into the unit case 30 from an opening 33 for incident light formed on the unit case 30. An image forming unit can also contain a unit case which has an integrated structure made of a single material, and the unit case can contain elements of process devices such as a charging device, a developing unit, a cleaning device and a quencher, e.g., a charging roller, a developing roller, a cleaning blade and a quenching lamp.

Each image forming unit 24 is not substantially different from each other except that the color of the developer is different from each other. At least two image forming units 24, four in FIGS. 1 and 3, are arranged close to each other side by side in parallel in the horizontal direction.

FIG. 3 illustrates the image forming apparatus 1 when a front door (not shown) thereof is opened, a face plate, which is described later, is removed, and the drawer 31 is pulled out from the image forming apparatus 1. As seen on this figure and FIG. 5, the drawer 31 contains a front frame plate 34, a rear frame plate 35, and a frame-formed drawer's main body 42 which contains multiple connecting boards 36A, 36B, 36C, 36D and 36E to connect these frame plates 34 and 35. In addition, slide rails 37 and 37A are fixed onto the connecting boards 36A and 36E, respectively. Also a pair of guide rails 38, one of which is shown in FIG. 3, are fixed in the image forming apparatus 1. The slide rails 37 and 37A fixed on the drawer 31 are abrasively mated with each guide rail 38. When the front door of the image forming apparatus 1 is opened, the face plate is removed and the drawer 31 is pulled in the direction indicated by arrow X, each slide rail 37 and 37A abrasively slides against each guide rail 38, and thereby the drawer 31 can be pulled out of the image forming apparatus 1 as illustrated in FIG. 3. In FIG. 3, the light irradiator 8, which is shown in FIG. 1, is not shown.

Figure 6:
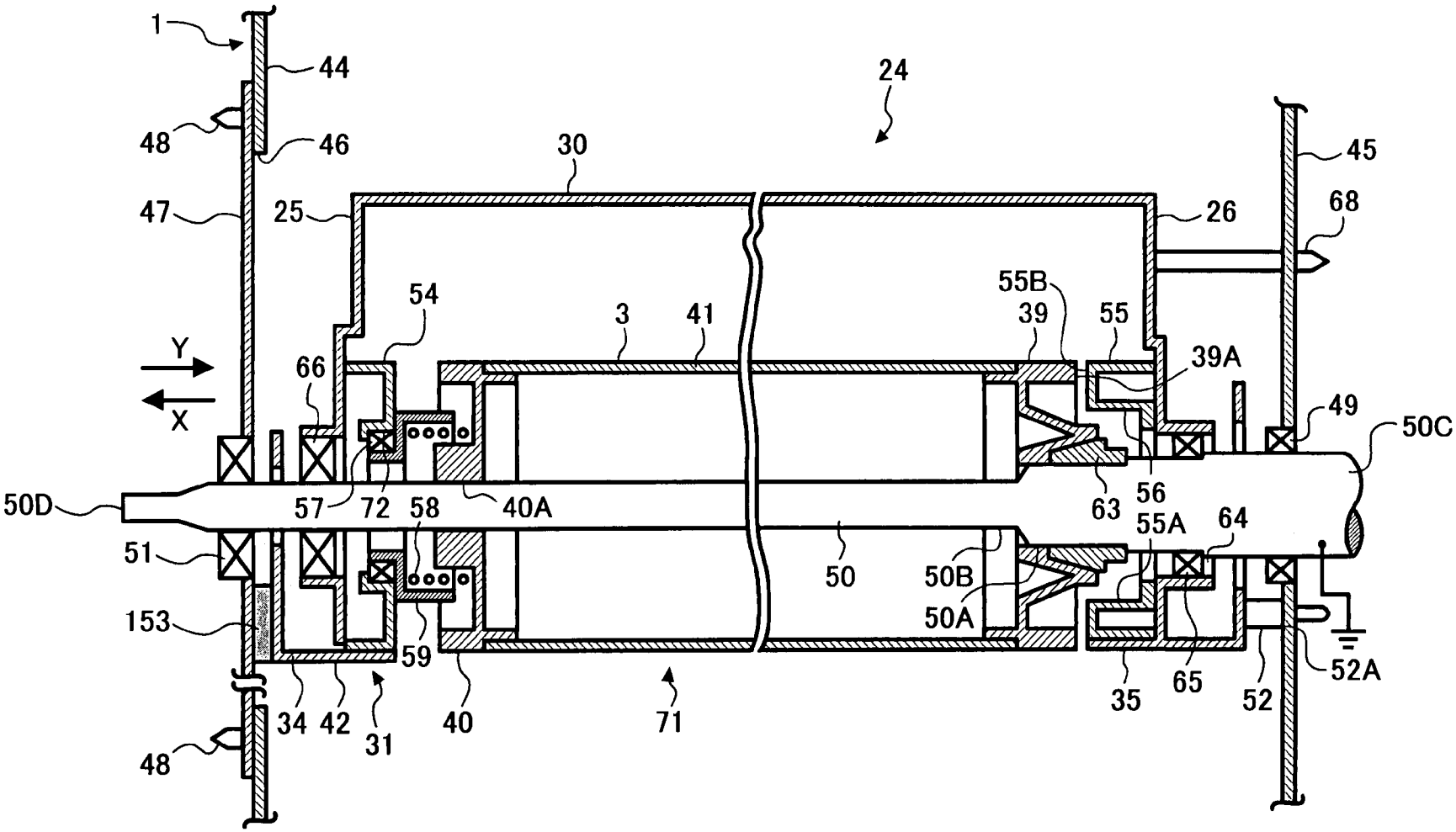
FIG. 6 is a vertical section illustrating the image forming apparatus in which the photoconductor and the image forming unit is set.

As illustrated in FIGS. 3 and 6, the photoconductor 3 contains a photoconductor's main body 41, which has a cylindrical form, and flanges 39 and 40 which are fixed at respective ends of the photoconductor's main body 41 in the direction of the axis thereof. Further, on the peripheral surface of the photoconductor's main body 41, the toner images of respective colors are formed as mentioned above. When the drawer 31 is pulled out, the photoconductor 3 and the image forming unit 24 are pulled out together with the drawer 31 from the image forming apparatus 1. When the drawer 31 is pushed into the image forming apparatus 1, the photoconductor 3 and the image forming unit 24 are pushed therein together with the drawer 31 and set in the predetermined loaded position. When the drawer 31 is supported such that the drawer 31 can be pulled out from the image forming apparatus 1, the drawer 31 can be pulled out as illustrated in FIG. 3 and the desired image forming unit 24 can be lifted upward, i.e., the image forming unit 24 can be removed from the drawer 31. Further, the photoconductor 3 can be removed. The image forming unit 24 and the photoconductor 3 can be set in the drawer 31 by the reverse operation. This reverse operation will be described later.

FIG. 6 is a vertical section illustrating the photoconductor 3, the image forming unit 24 and the drawer 31 when these stand in the predetermined position in the image forming apparatus 1. The image forming unit 24 is simplified and only the unit case 30 is shown. As illustrated in FIG. 6, the drawer 31, the photoconductor 3 and the image forming unit 24 are pulled out in the direction indicated by the arrow X and pushed in the direction indicated by the arrow Y mentioned above. In this embodiment, the front side is the side to which the photoconductor 3 and the image forming unit 24 are pulled out and the rear side is opposite to the front side.

As illustrated in FIG. 6, the body frame of the image forming apparatus 1 has a front plate 44 located on the front side and a rear plate 45 located on the rear side. An opening 46 is closed by the front plate 44 and the face plate 47 which is detachably fixed onto the front plate 44 with a screw (not shown). A positioning pin 48 fixed on the front plate 44 fits in a hole formed on this face plate 47 and therefore the face plate 47 is correctly positioned against the front plate 44.

In addition, as illustrated in FIG. 6, the rear plate 45 of the image forming apparatus 1 and a supporting plate (not shown) fixed on the rear plate 45 support a first rear axis portion 50C of a cylindrical axis 50 with a bearing 49 therebetween such that the first rear axis portion 50C can rotate around its axis. Also, a front axis portion 50D of the axis 50 is rotatably supported by the face plate 47 with a bearing 51 pressed in the face plate 47 therebetween.

Figure 5:
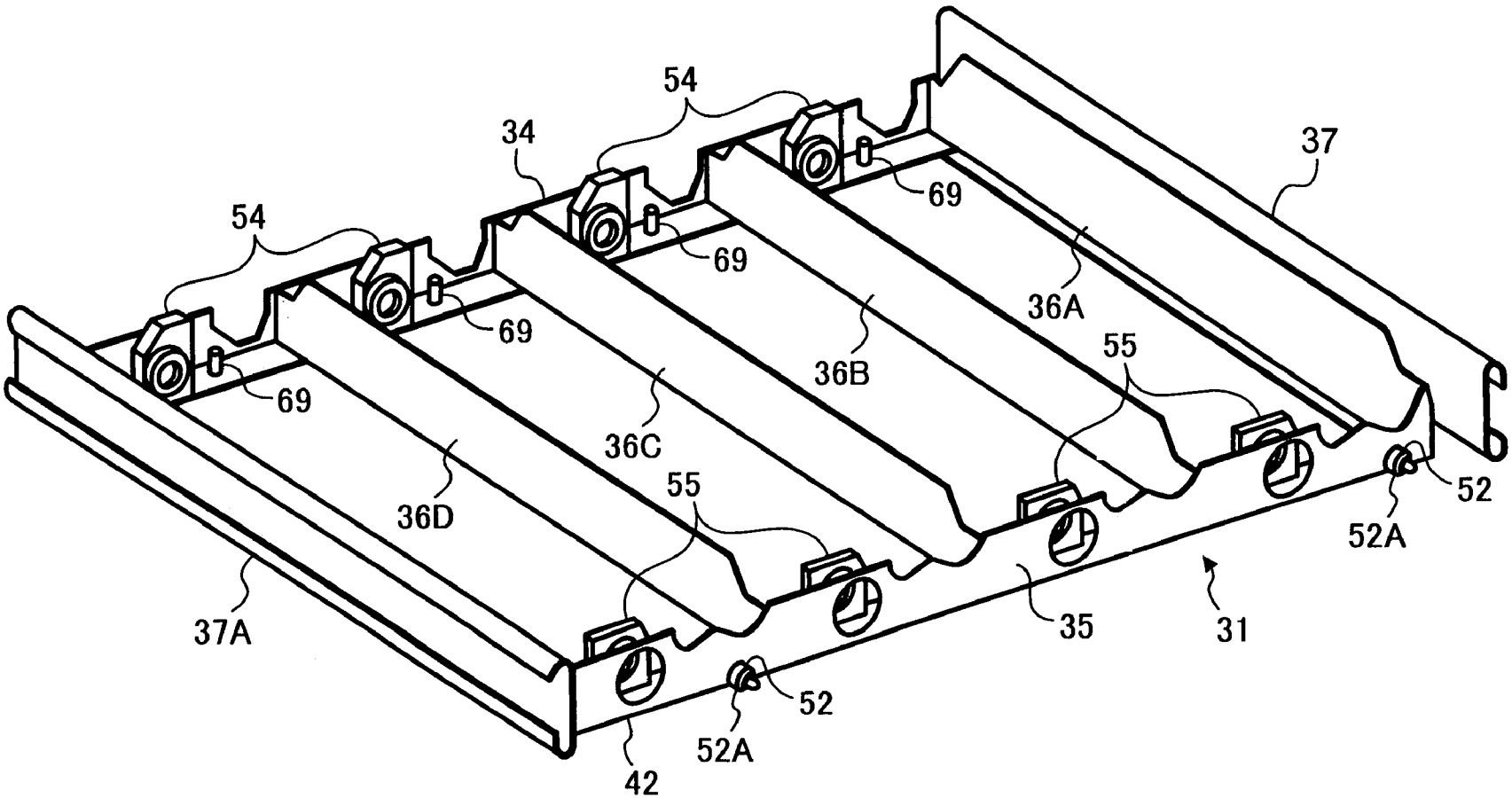
FIG. 5 is a perspective view illustrating the drawer looking from behind.

FIG. 5 is a view illustrating the drawer 31 from behind. As illustrated in FIG. 5, there are multiple rear pins 52 protruding from the rear frame plate 35 of the drawer 31. As illustrated in FIG. 3, there are multiple front pins 53 protruding from the front frame plate 34 of the drawer 31. The rear pins 52 and the front pins 53 detachably fit in the positioning holes formed on the rear plate 45 and the face plate 47, respectively. As illustrated in FIG. 6, an elastic member 153 consisting of an elastic material such as rubber is fixed on the face plate 47. When the pins fit in the holes, the front frame plate 34 of the drawer 31 is brought into contact with the elastic member 153 and therefore the drawer is pressed back. As a result, a rung 52A of the rear pin 52 illustrated in FIGS. 5 and 6 is pressed to the rear plate 45. Thus the drawer 31 can be stably positioned on the body frame of the image forming apparatus 1.

Furthermore, as illustrated in FIG. 6 and FIG. 8, a center hole 39B of the flange 39 (hereinafter referred to as rear flange) located on the rear portion of the photoconductor 3 stably fits in a first axial portion 50A of the axis 50 such that the axis 50 can abrasively slide in its axial direction. Similarly, a center hole 40A of the flange 40 (hereinafter referred to as front flange) located on the front portion of the photoconductor 3 also stably fits in a front portion of the axis 50 such that the axis 50 can abrasively slide in its axial direction.

Further, as illustrated in FIGS. 5 and 6, the bases of a front holder 54 and a rear holder 55 are fixed onto the front frame plate 34 and the rear frame plate 35 of the drawer 31, respectively. The drawer 31 contains the drawer's main body 42, and the rear holder 55 and the front holder 54, which are fixed onto the drawer's main body 42. A portion of the rear flange 39 of the photoconductor 3 is inserted into a rear hole 56 formed on the rear holder 55. However, when the drawer 31, the photoconductor 3 and the image forming unit 24 sit in the predetermined position in the image forming position 1, the rear flange 39 does not contact the rear holder 55.

Furthermore, as illustrated in FIG. 6, the axis 50 pierces the front holder 54 and the rear holder 55 extending without contacting therewith. A spring seat member 59 for compressed spring 58 containing a helical compression spring is rotatably supported with a bearing 57 located at a front hole 72 formed on the front holder 54. An end of this compressed spring 58 and the other end thereof contact and press the spring seat 59 having a ring form and the front flange 40 of the photoconductor 3, respectively. Thus the photoconductor 3 is pressed to the rear direction. The axis 50 pierces inside the spring seat member 59 and the compressed spring 58 and further pierces the front frame plate 34 and the rear frame plate 35 of the drawer 31.

Figure 7:
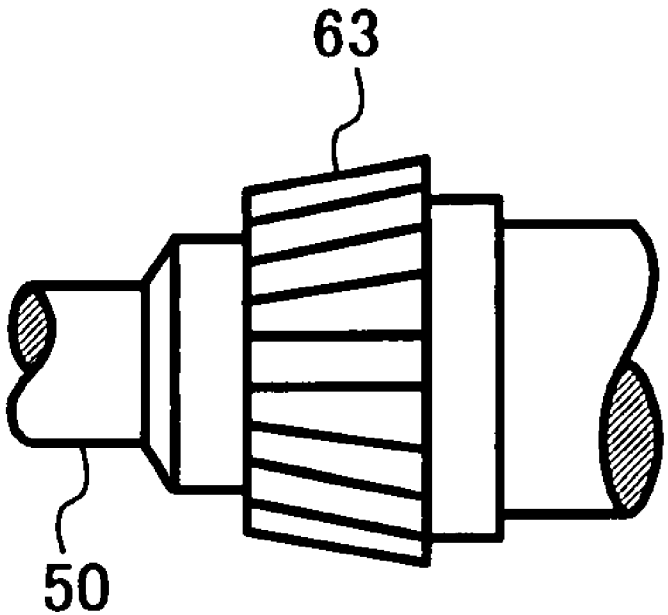
FIG. 7 is a view illustrating the engagement member fixed onto the axis.

As illustrated FIGS. 6 and 7, an engaging member 63 is fixed onto a rear portion of the axis 50. The engaging member 63 has a tapering form and a number of teeth around the peripheral face thereof. The teeth of the engaging member 63 engage with a number of teeth (not shown) formed on the inner circular face of the rear flange 39 of the photoconductor 3. Since the photoconductor 3 is pressed to the rear direction by the compressed spring 58 at this time as mentioned above, the teeth of the rear flange 39 firmly engage with the teeth of the engaging member 63. Therefore, the rear flange 39 and engaging member 63 cannot move in the axial direction or rotate against each other (State A). When a motor (not shown) connected with a rear end portion of the axis 50 operates and rotates the axis 50 around its axis while in State A, the rotational movement is conveyed to the photoconductor 3 by the engaging member 63 that is in contact with the photoconductor 3. Thereby the photoconductor 3 also rotates around its central axis and the image forming operation mentioned above is performed. While the photoconductor 3 is in rotation, the spring seat member 59 and the compressed spring 58 rotate in unison with the photoconductor 3. The engaging member 63, which transmits the rotational movement of the axis 50 to the photoconductor 3, is one of the driving connecting elements which are engaged with the photoconductor 3.

As illustrated in FIGS. 4 and 6, a pierce hole 64 is formed on the back wall 26 of the unit case 30. A bearing 65 pressed in the axis 50 firmly fits in this pierce hole 64 and slidably fits therein in the axial direction of the axis 50. In addition, as illustrated in FIGS. 3 and 6, a bearing 66 is pressed in the pierce hole formed on the front wall 25 of the unit case 30 of the image forming unit 24. The bearing 66 firmly and slidably fits in the pierce hole in the axial direction of the axis 50. Therefore, when the image forming unit 24 sits in the predetermined position in the image forming apparatus 1, a rear end of the image forming unit 24, i.e., the back wall 26 in this embodiment, and a front end thereof the image forming unit, i.e., the front wall 25 in this embodiment, fit in the axis 50 via the bearings 65 and 66. Therefore, the position of the image forming unit 24 is determined as to the radius direction of the axis 50 including the vertical direction relative to the axis 50.

Further, as illustrated in FIG. 3, a reference pin 67 protruding from the front wall 25 of the unit case 30 detachably fits in a positioning hole (not shown) formed on the face plate 47. Also, as illustrated in FIG. 4, the other reference pin 68, which protrudes from the back wall 26 of the unit case 30, detachably fits in a positioning hole (not shown) formed on the rear plate 45 as illustrated in FIG. 6. The reference pins 67 and 68 regulate the angular positioning of the image forming unit 24 relative to the central axis of the axis 50. Further, as illustrated in FIG. 5, the front frame plate 34 of the drawer 31 has multiple pins 69 protruding therefrom and each of the pins 69 detachably fits in respective holes (not shown) formed on each unit case 30. Thereby the position of each image forming unit 24 is determined as to the axial direction of the axis 50.

Figure 8A:
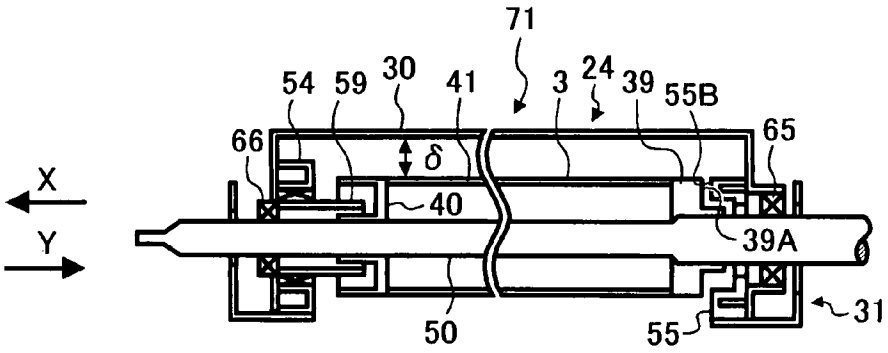
FIG. 8 is a schematic view illustrating the behaviors of when the assembled drawer is pulled out.
Figure 8B:
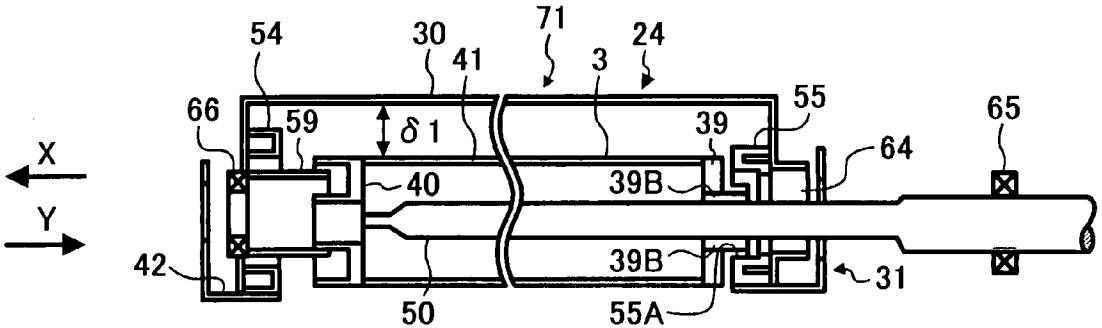
Figure 8C:
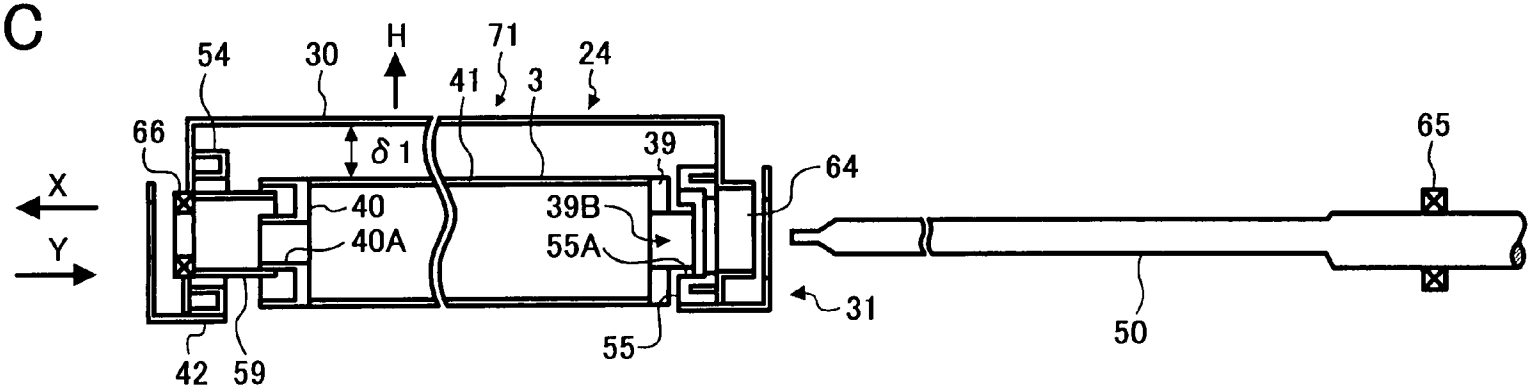

The assembled combination of the drawer 31, the photoconductor 3 and the image forming unit 24 as illustrated in FIG. 6 is referred to as an assembled drawer 71. FIGS. 8A to 8C are schematic diagrams illustrating the states of the assembled drawer 71 when the assembled drawer 71 is being pulled out. In FIG. 8, some members are omitted, each member shown therein is simplified and the hatching representing the cross section thereof is also omitted.

FIG. 8A illustrates the assembled drawer 71 in the same state as that illustrated in FIG. 6, i.e., the state where the assembled drawer 71 sits in the predetermined position in the image forming apparatus 1. As mentioned above, when the front door of the image forming apparatus 1 is opened and the face plate 47 illustrated in FIG. 6 is removed from the front plate 44 and thus an opening 46 is opened, the front pin 53 of the drawer 31 is removed from the positioning hole of the face plate 47 and the bearing 51 pressed in the face plate 47 is removed from the axis 50. Then, when the drawer 31 is pulled out to the front-side direction, i.e., the direction indicated by the arrow X, the entire assembled drawer 71 slides to the front-side direction and is pulled out as illustrated in FIGS. 8B and 8C. That is, when the drawer 31 is pulled to the front-side direction, the rear pin 52 of the drawer 31 illustrated in FIG. 6 is detached from the positioning hole formed on the rear plate 45 of the image forming apparatus 1 and therefore the drawer 31 slides out. Then the image forming unit 24, which is connected to the drawer 31 with the pin 69 illustrated in FIG. 5, also slides out to the front-side direction together with the drawer 31. In addition, as illustrated in FIG. 6, a portion 55B of the rear holder 55 of the drawer 31 presses a portion 39A of the rear flange 39 of the photoconductor 3 and thereby the photoconductor 3 moves to the rear-side. Therefore, the central hole 39B of the rear flange 39 is removed from the engaging member 63 fixed onto the axis 50 illustrated in FIG. 6.

At the time when the drawer 31 is pulled out, the rear end of the axis 50 is still supported by the image forming apparatus 1 and therefore the axis 50 is partially pulled out from the photoconductor 3 and the image forming unit 24. As illustrated in FIG. 8C, when the drawer 31 is completely pulled out, the axis 50 is drawn out from the photoconductor 3 and the image forming unit 24. That is, when the drawer 31 is pulled out to the front-side direction together with the photoconductor 3 and the image forming unit 24, the above-mentioned fit-in of the image forming unit 24 and the axis 50 via bearings 65 and 66 is ended.

Figure 9:
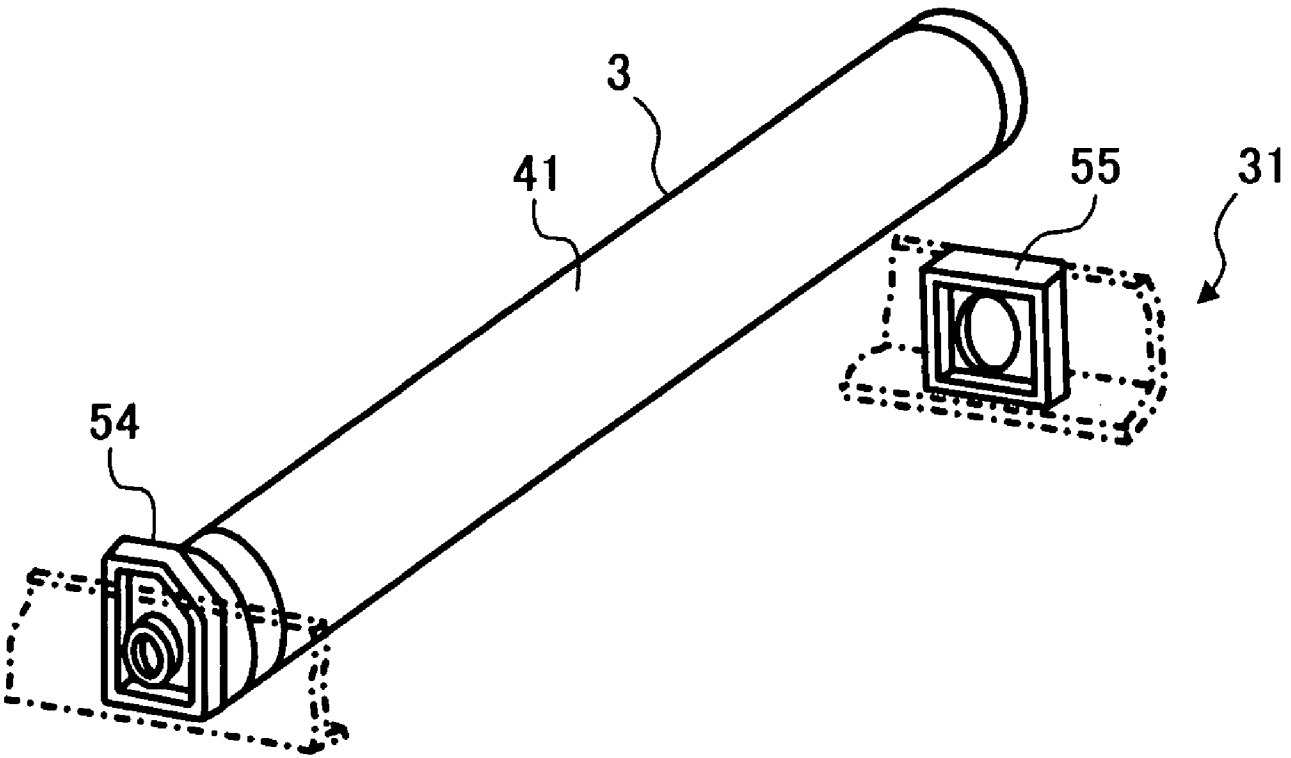
FIG. 9 is a perspective view illustrating the drawer and the photoconductor when the photoconductor is detached from the drawer.

In the state illustrated in FIG. 8C, the photoconductor 3 and the image forming unit 24 are disengaged from the axis 50. Therefore, the image forming unit 24 can be detached from the drawer 31 by lifting the image forming unit 24 to the direction indicated by arrow H. Further, it is possible to detach the rear flange 39 of the photoconductor 3 from the rear holder 55 by pressing the photoconductor 3 and thereby compressing and transforming the compressed spring 58 illustrated in FIG. 6. Therefore, as illustrated in FIG. 9, the photoconductor 3 can be detached from the drawer 31 by lifting up a rear portion of the photoconductor 3.

The photoconductor 3 and the image forming unit 24 can be assembled onto the drawer 31 by the reverse operation. Then, when the drawer 31 in the assembled drawer 71 is pushed along the direction indicated by the arrow Y in FIG. 8C, the image forming unit 24 moves to the rear direction together with the drawer 31 and the front flange 40 of the photoconductor 3 is pressed by the drawer 31 with the spring seat member 59 and the compressed spring 58 located therebetween to the rear direction. Therefore the photoconductor 3 moves to the rear end and the entire assembled drawer 71 is pushed to the rear end. Thus the axis 50 is inserted into the photoconductor 3 and the image forming unit 24 and the assembled drawer 71 is set in the predetermined position in the image forming apparatus 1 as illustrated in FIG. 6. When the photoconductor 3 and the image forming unit 24 are pushed to the rear end together by the drawer 31, the rear end and the front end of the image forming unit 24 fit in the axis 50 via the bearings 65 and 66 located therebetween, respectively. That is, not only the bearing 65 fixed onto the axis 50 fits in the pierce hole 64 located on the rear end of the image forming unit 24 but also the bearing 66 pressed in the front end of the image forming unit 24 fits in the axis 50. Thereby, the position of the image forming unit 24 is determined against the image forming apparatus 1 as to the vertical direction. Also the reference pin 68 of the image forming unit 24 fits in the positioning hole of the rear plate 45. In addition, the rear pin 52 of the drawer 31 also fits in the positioning hole of the rear plate 45 and therefore the drawer 31 is positioned as to the vertical direction. Furthermore, the flanges 39 and 40 of the photoconductor 3 fit in the center holes 39B and 40A of the axis 50, respectively. Therefore the position of the photoconductor 3 is determined as to the radius direction including the vertical direction. Additionally, as illustrated in FIG. 6, it is preferred that the axis 50 have a front free end having a small radius or a tapered form to smoothly perform these fit-ins.

As mentioned above, the image forming apparatus 1 illustrated in this embodiment has the drawer 31 which is supported to be able to slide forward and backward against the image forming apparatus 1. The photoconductor 3 and the image forming unit 24 are supported such that the photoconductor 3 and the image forming unit 24 slide together with the drawer 31 when the drawer 31 is slid forward or backward. In addition, the image forming apparatus 1 also has the axis 50 which is supported at its rear end by the image forming apparatus 1. The photoconductor 3 and the image forming unit 24 are detachably assembled to the axis 50 in its axial direction. Further, when the photoconductor 3 and the image forming unit 24 are pulled out together with the drawer 31 and are removed from the axis 50 supported by the image forming apparatus 1, the image forming unit 24 and the photoconductor 3 can be separately detached from the drawer 31.

Since each of the photoconductors 3 and the image forming units 24 can be separately detached, when only one of the photoconductor 3 and the image forming apparatus 24 malfunctions, it is possible to change only the malfunctioning one. As a result, with this structure, users can avoid unnecessary economic burden.

As illustrated in FIG. 2, when the image forming unit 24 and the photoconductor 3 sit in the image forming apparatus 1, elements of the image forming unit 24, such as the charging roller 15, the developing roller 18 and the cleaning blade 21, are brought into contact with or located in the vicinity of the surface of the photoconductor's main body 41. When the image forming unit 24 and the photoconductor 3 are pulled out or pushed in together with the drawer 31 while the image forming unit 24 and the photoconductor 3 are situated as illustrated in FIG. 2, the elements of the image forming unit 24 contact the photoconductor 3. Therefore a large impact due to the shock caused by pulling and pushing the drawer 31 may damage the photoconductor 3. Similarly, when the drawer 31 is pulled out as illustrated in FIG. 8C and then the image forming unit 24 is lifted upward, the elements of the image forming unit 24 may impact the surface of the photoconductor 3, resulting in damage on the photoconductor 3 and the elements of the image forming unit 24. This may also occur when the image forming unit 24 is assembled onto the drawer 31.

Figure 10:
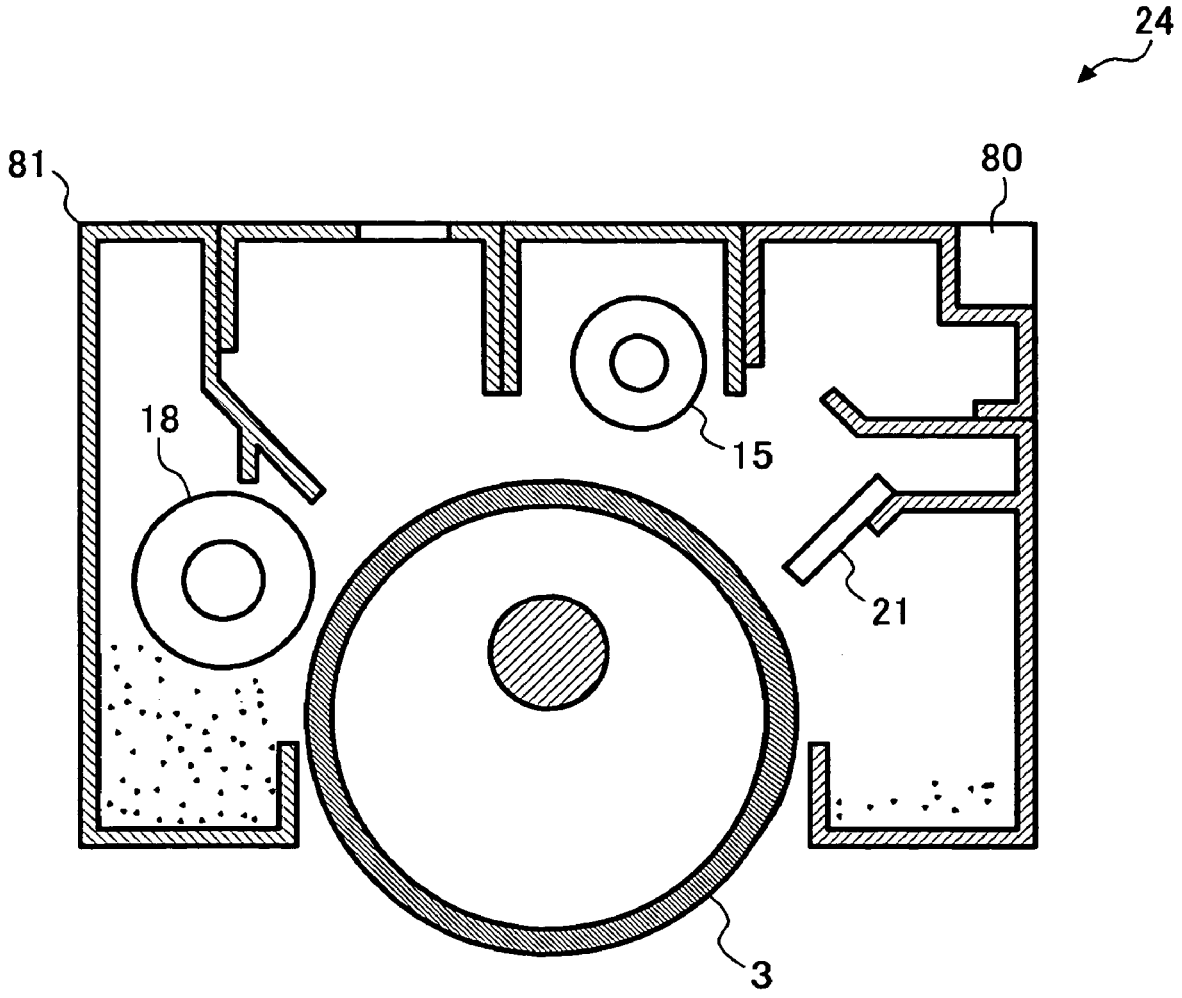
FIG. 10 is a cross section illustrating the image forming unit and the photoconductor when the photoconductor moves downward relative to the image forming unit.

To avoid such an impact resulting in damage, when the photoconductor 3 and the image forming unit 24 are pulled out together with the drawer 31, the photoconductor 3 moves downward relative to the image forming unit 24 as illustrated in FIGS. 8A to 8C. Also when the photoconductor 3 and the image forming unit 24 are pushed in to the rear end together with the drawer 31, the photoconductor 3 moves upward relative to the image forming unit 24. In FIG. 8, characters 6 and 61 represent the distances between the image forming unit 24 and the photoconductor 3. That is, the distance 61 of when the assembled drawer 71 is pulled out is greater than the distance 6 of when the assembled drawer 71 sits in the image forming apparatus 1. FIG. 10 is a diagram illustrating the state in which the distance between the image forming unit 24 and the photoconductor 3 is larger in the vertical direction and therefore the charging roller 15, the developing roller 18 and the cleaning blade 21 of the image forming unit 24 are distant from the surface of the photoconductor 3.

As mentioned above, as the photoconductor 3 and the image forming unit 24 are pulled out or pushed in with the drawer 31 the distance between the elements of the image forming unit 24 and the photoconductor 3 becomes larger or smaller. Therefore, the possibility of impact and impact force is decreased. Therefore, if a shock is given to the image forming unit 24 or the photoconductor 3, a contact between the elements of the image forming unit 24 and the photoconductor 3 can be minimized or avoided. Further, it is also possible to minimize or avoid damage to the surface of the photoconductor 3 or the image forming unit 24 when the image forming unit 24 is detached from the photoconductor 3 after the drawer 31 is pulled out.

What will be described next is a specific example of the structure in which the distance between the image forming unit 24 and the photoconductor 3 is increased and the image forming unit 24 and photoconductor 3 become relatively distant from each other in the vertical direction as the assembled drawer 71 is pulled out.

As illustrated in FIG. 6, when the photoconductor 3 and the image forming unit 24 sit in the predetermined position in the image forming apparatus 1, the portion of the axis 50 which fits in the rear flange 39 of the photoconductor 3 is referred to as the first axial portion 50A and the portion of the axis 50 between the first axial portion 50A and the front end of the axis 50 is the second axial portion 50B. The diameter of the second axial portion 50B is small compared with that of the first axial portion 50A. The difference between both diameters is, for example, approximately 1 mm.

When the photoconductor 3 and the image forming unit 24 are drawn out together with the drawer 31 to the direction indicated by the arrow X, the rear end of the photoconductor 3, i.e., the rear flange 39, shifts from the first axial portion 50A to the second axial portion 50B. At this time, the rear end of the photoconductor 3 moves downward by its own weight and the rear end of the photoconductor 3 which has moved downward is received by the rear holder 55 of the drawer 31. That is, as illustrated in FIGS. 8B and 8C, the rear flange 39 drops downward and is held by a receiving face 55A located on the lower portion of the inner face of the rear holder 55. When the assembled drawer 71 is drawn, the front end of the photoconductor 3, i.e., the front flange 40, comes off the axis 50. Therefore, as illustrated in FIGS. 8B and 8C, the photoconductor 3 moves downward by its own weight and the front flange 40 is held by the front holder 54 of the drawer 31 with the compressed spring 58 illustrated in FIG. 6, the spring seat member 59 and the bearing 57 located therebetween. That is, the front end of the photoconductor 3 which has dropped downward is held by the front holder 54.

When the drawer 31 is pushed in to the rear end together with the image forming unit 24 and the photoconductor 3, the front end of the photoconductor 3, i.e., the front flange 40 fits in the axis 50. Then the rear end of the photoconductor 3, i.e., the rear flange 39, moves from the second axial portion 50B to the first axial portion 50A and shifts upward. Thus, the position of the photoconductor 3 is determined as to its radius direction including the vertical direction. The relative positions of each element of the image forming unit 24 and the photoconductor 3 in the vertical direction is as illustrated in FIG. 2.

In the image forming apparatus 1 described above, the image forming unit 24 contains multiple process devices. However, the image forming unit may also have only one process device. Also, in the image forming apparatus 1 illustrated, the image forming unit 24 does not include the photoconductor 3 within the image forming unit. However, the photoconductor 3 can be included within the image forming unit 24 by, for example, rotatably assembling the photoconductor 3 onto the unit case 30. That is, an image forming unit including a photoconductor and at least one process device by which a toner image is formed on the photoconductor is allowable. In other words, the image forming unit is what minimally includes a photoconductor and at least one of the process devices by which a toner image is formed on the photoconductor.

In addition, in the image forming apparatus 1 in this embodiment, each image forming unit 24 is supported such that each image forming unit 24 can be pulled out or pushed in the image forming apparatus. Further, each image forming unit 24 can be lifted upward after each image forming unit 24 is pulled out to the front direction. In the illustrated embodiment, the image forming unit 24 is set onto the drawer 31 and supported such that the image forming unit 24 can be pulled out or pushed in the image forming apparatus 1 together with the drawer 31. However, it is also allowable to support the image forming unit 24 by a guiding means instead of the drawer 31 such that the image forming unit 24 is directly pulled out or pushed in the image forming apparatus 1.

In the image forming apparatus 1 illustrated, there are multiple image forming units 24 which are arranged in parallel in the arrangement direction in the image forming apparatus 1 while each image forming unit 24 is set close to or brought into contact with the adjacent image forming unit 24. In this case, any of the image forming unit 24 can be easily grasped and lifted upward as illustrated in FIG. 3. This is because the unit case 30 for the image forming unit 24 has a notch 80 to hold the image forming unit 24 as illustrated in FIGS. 1 to 4 and 10. That is, a user can grasp the notch 80 formed on the unit case 30 and a corner portion 81 of the unit case 30 facing the notch 80 with his or her thumb and fingers and lift any of the image forming unit 24 upward. This is also applicable when the image forming unit 24 is set on the drawer 31.

The same effect can be expected when a protruding handle is provided to the unit case 30. However, with a handle it is unavoidable that the image forming unit 24 occupies a large space in the image forming apparatus 1 when the image forming unit 24 is set therein. To the contrary, in the case of the image forming apparatus 1 in this embodiment, when the image forming unit 24 is set in the image forming apparatus 1, the image forming unit 24 does not occupy a large space since it does not have the protruding handle, but instead the notch 80 that is formed on the unit case 30 of each image forming unit 24.

Further, when the image forming unit having a handle protruding from the unit case is drawn from or pushed in the image forming apparatus, the handle may interfere with the light irradiator 8 located above the image forming unit as illustrated in FIG. 1. In contrast, the image forming unit 24 in this embodiment is free from such problems.

As seen on FIGS. 1 and 3, each unit case 30 has one notch 80 on the top thereof and the notch 80 is formed on the same side relative to the arrangement direction W of the image forming units 24 as illustrated in FIG. 3. In the embodiment illustrated in FIG. 3, the notch 80 is formed on the right hand side of the image forming unit 24. Therefore, there is an opening between the adjacent image forming units 24 arranged in parallel in the arrangement direction and therefore a user can insert his fingers into the opening to grasp any of the image forming unit 24 surely and easily.

In addition, each of the illustrated image forming unit 24 of the image forming apparatus 1 contains a process device having the developing unit 9 by which a latent electrostatic image formed on the photoconductor 3 is visualized as a toner image. The developing unit case 17 for the developing unit 9 is included in the unit case 30. The notch 80 mentioned above is preferably not formed on the developing unit case 17 but on a different portion of the unit case 30, i.e., the second stay 28. The notch 80 can be formed on the developing unit case 17 but this makes the inner space of the developing unit case 17 small. Consequently, the capacity of the toner accommodated therein may be small. In contrast, such problems does not occur to the case of the illustrated embodiment.

This document claims priority and contains subject matter related to Japanese Patent Application No. 2003-161293 filed on Jun. 5, 2003, incorporated herein by reference.

Having now fully described embodiments of the present invention, it will be apparent to one of ordinary skill in the art that many changes and modifications can be made thereto without departing from the spirit and scope of embodiments of the invention as set forth herein.

The invention claimed is:

1. An image forming apparatus, comprising:

at least two image forming units arranged side by side in an arrangement direction, wherein each of the at least two image forming units comprises:

a photoconductor configured to bear a latent electrostatic image thereon;

at least one process device configured to form a toner image on the photoconductor; and a unit case having a notch thereon to grasp the unit case, the notch being disposed on a corner formed by an intersection of a top surface and a side surface of said unit case.

2. The image forming apparatus according to claim 1, wherein the at least one process device is selected from the group consisting of a charger, a developing device, a cleaner and a quencher.

3. The image forming apparatus according to claim 1, wherein the notch is provided on an upper part of the unit case and formed at a same end of the unit case relative to the arrangement direction.

4. The image forming apparatus according to claim 1, wherein each of the at least two image forming units is slidably supported and arranged to be pulled out of the image forming apparatus and pushed into the image forming apparatus, and wherein after the image forming units are pulled out of the image forming apparatus, each of the at least two image forming units can be lifted upward and detached from the image forming apparatus.

5. The image forming apparatus according to claim 4, wherein as each of the at least two image forming units are pulled out of the image forming apparatus, a distance between the at least one process device and the photoconductor increases, and when each of the at least two image forming units are pushed into the image forming apparatus, the distance between the at least one process device and the photoconductor decreases.

6. The image forming apparatus according to claim 1, wherein the photoconductor is configured to detach from the image forming unit.

7. The image forming apparatus according to claim 6, wherein the notch is formed on a stay portion of the unit case that connects a front wall and back wall of the unit case.

8. The image forming apparatus according to claim 1, wherein the notch is formed on a stay portion of the unit case that connects a front wall and back wall of the unit case.

9. The image forming apparatus according to claim 1, wherein the at least one process device includes a developing device configured to convert a latent electrostatic image formed on the photoconductor into a toner image, the developing device including a developing device case that constitutes a portion of the unit case, and wherein the notch is formed on a portion of the unit case other than the developing device case.

10. The image forming apparatus according to claim 1, wherein the notch extends along a longitudinal direction of the unit case.

11. The image forming apparatus according to claim 10, wherein the notch extends only along a central portion of the unit case.

12. An image forming unit, comprising:

a photoconductor configured to bear a latent electrostatic image thereon;

at least one process device configured to form a toner image on the photoconductor; and a unit case having a notch thereon to grasp the unit case, the notch being disposed on a corner formed by an intersection of a top surface and a side surface of said unit case.

13. The image forming unit according to claim 12, wherein the notch is formed on a stay portion of the unit case that connects a front wall and back wall of the unit case.

14. The image forming unit according to claim 12, wherein the photoconductor is configured to detach from the image forming unit.

15. The image forming unit according to claim 14, wherein the notch is formed on a stay portion of the unit case that connects a front wall and back wall of the unit case.

16. The image forming unit according to claim 12, wherein the at least one process device includes a developing device configured to convert a latent electrostatic image formed on the photoconductor into a toner image, the developing device including a developing device case that constitutes a portion of the unit case, and wherein the notch is formed on a portion of the unit case other than the developing device case.

17. The image forming apparatus according to claim 12, wherein the notch extends along a longitudinal direction of the unit case.

18. The image forming apparatus according to claim 17, wherein the notch extends only along a central portion of the unit case.

19. An image forming apparatus, comprising:

means for forming a latent electrostatic image on a photoconductor;

means for converting the latent electrostatic image into a toner image; and means for grasping, removing, and replacing the means for forming a latent electrostatic image.

20. A method for removing an image forming unit from an image forming apparatus comprising:

pulling out a supporting device comprising at least two slidably supported image forming units arranged side by side from the image forming apparatus;

grasping at least one of the at least two slidably supported image forming units using at least one notch formed on an upper part of each image forming unit on a corner formed by an intersection of a top surface and a side surface of the image forming unit; and lifting any one of the at least two image forming units from the supporting device in the image forming apparatus.

* * * * *